US005624243A

United States Patent [19]

Omodaka et al.

[11] Patent Number: 5,624,243

[45] Date of Patent: Apr. 29, 1997

[54] SCROLL COMPRESSOR CAPABLE OF EFFECTIVELY COOLING MOTOR THEREOF

[75] Inventors: Masatoshi Omodaka; Hiroki Kamiishida; Yoshitaka Shibamoto; Hiroyuki Taniwa, all of Osaka, Japan

[73] Assignee: Daikin Industries, Ltd., Osaka, Japan

[21] Appl. No.: 537,739

[22] PCT Filed: Mar. 7, 1995

[86] PCT No.: PCT/JP95/00361

§ 371 Date: Nov. 1, 1995

§ 102(e) Date: Nov. 1, 1995

[87] PCT Pub. No.: WO95/24561

PCT Pub. Date: Sep. 14, 1995

[30] Foreign Application Priority Data

Mar. 9, 1994 [JP] Japan ..... 6-38118

[51] Int. Cl.[6] ..... F04B 39/06

[52] U.S. Cl. ..... 417/366; 417/410.5

[58] Field of Search ..... 417/366, 372, 417/410.5, 410.4

[56] References Cited

U.S. PATENT DOCUMENTS

| | | | |
|---|---|---|---|
| 4,365,941 | 12/1982 | Tojo et al. | 417/372 |
| 4,518,323 | 5/1985 | Elson et al. | 417/372 |
| 4,518,324 | 5/1985 | Mizuno et al. | 417/366 |
| 4,568,253 | 2/1986 | Wood | 417/372 |
| 4,592,703 | 6/1986 | Inaba et al. | 417/372 |
| 4,645,429 | 2/1987 | Asami et al. | 417/366 |
| 5,040,952 | 8/1991 | Inoue et al. . | |
| 5,090,876 | 2/1992 | Hashizume et al. | 417/366 |
| 5,110,268 | 5/1992 | Sakurai et al. | 417/410.5 |
| 5,129,798 | 7/1992 | Crum et al. . | |
| 5,295,808 | 3/1994 | Machida et al. | 417/366 |
| 5,322,420 | 6/1994 | Yannascoli | 417/366 |

FOREIGN PATENT DOCUMENTS

| | | |
|---|---|---|
| 2-227583 | 9/1990 | Japan . |
| 2-301687 | 12/1990 | Japan . |
| 3-32189 | 3/1991 | Japan . |
| 3-124985 | 5/1991 | Japan . |
| 4-12193 | 1/1992 | Japan . |
| 4-27789 | 1/1992 | Japan . |
| 5001678 | 1/1993 | Japan . |
| 5-79475 | 3/1993 | Japan . |
| 5-312162 | 11/1993 | Japan . |

*Primary Examiner*—Timothy Thorpe
*Assistant Examiner*—William Wicker
*Attorney, Agent, or Firm*—Birch, Stewart, Kolasch & Birch, LLP

[57] ABSTRACT

A discharge passage 15 which communicates with a discharge outlet 16 of a compressing section 3 and discharges compressed gas into a chamber S1 opposite to the compressing section with respect to a motor 2 is provided axially through a drive shaft 4 of the motor 2. An outward discharge pipe 17 is opened at a middle chamber S2 provided between the compressing section 3 and the motor 2 inside a hermetic casing 1. An effect of cooling the motor 2 by discharge gas can be fully exerted, so that possible temperature increase of the motor 2 is prevented to improve reliability and efficiency of the motor 2, and oil mixed in the discharge gas is separated.

8 Claims, 2 Drawing Sheets

SCROLL COMPRESSOR CAPABLE OF EFFECTIVELY COOLING MOTOR THEREOF

FIELD OF THE INVENTION

The present invention relates to a scroll compressor, and in particular, to a high-pressure dome type scroll compressor.

DESCRIPTION OF BACKGROUND ART

Conventionally, an example of a high-pressure dome type scroll compressor is disclosed in Japanese Patent Laid-Open Publication No. HEI 5-79475. The scroll compressor disclosed in the above publication is a co-rotational type scroll compressor having a driven scroll which rotates in accordance with a rotating motion of a drive scroll. The co-rotational type scroll compressor has a construction as shown in FIG. 2 in which the inside of a vertical type hermetic casing A is separated into upper and lower hermetic sections by a partition wall P, thereby forming a motor chamber A1 and a compressing chamber A2 in the upper and lower sections, respectively. Then, a motor B is installed in the motor chamber A1, while a co-rotational type scroll compressor C is installed in the compressing chamber A2. The scroll compressor C is comprised of a drive scroll E which is formed at an end of a drive shaft D connected to the motor B, and a driven scroll G which has a driven shaft F and is driven in accordance with the drive scroll E. The drive shaft D is rotatably supported at a pipe-shaped first bearing section H formed upright at the partition wall P, i.e., a bottom wall of the motor chamber A1, while the driven shaft F is rotatably supported at a pipe-shaped second bearing section I formed upright in a position located eccentrically with respect to the first bearing section H at a bottom wall of the compressing chamber A2. Further, the drive shaft D is formed internally axially with a high-pressure gas discharge passage D1 which extends vertically. A lower portion of the discharge passage D1 communicates with a discharge outlet E1 provided at a center portion of the drive scroll E, while an upper portion of the discharge passage D1 is opened to the motor chamber A1. Further, an outward discharge pipe J is opened in a position at a side of the opening of the discharge passage D1 on the upper side of the motor chamber A1, while an intake pipe K is opened at the compressing chamber A2.

When, the drive scroll E is rotatively operated via the drive shaft D upon rotation of the motor B, with which the driven scroll G is rotated in accordance with the rotation of the drive scroll E with the driven shaft F rotatably supported at the second bearing section I. Thus, the introduced gas, which has been introduced from the intake pipe K into the compressing chamber A2, is inhaled into the compressing chamber formed between both the scrolls E and G, and then compressed. The compressed gas is discharged from the discharge outlet E1 via the discharge passage D1 into the motor chamber A1, and then discharged outwardly from the discharge pipe J opened at the motor chamber A1.

However, in the above-mentioned compressor, the outward discharge pipe J is opened near the opening of the discharge passage D1 in the position at the side of the opening of the discharge passage D1 on the upper side of the motor chamber A1. Therefore, most of the gas discharged from the discharge passage D1 into the motor chamber A1 is disadvantageously discharged directly to the outside from the discharge pipe J. Therefore, when the discharge gas passes through the discharge passage D1, a center portion of a rotor B1 of the motor B can be cooled by the discharge gas. However, the effect of cooling the motor B by the discharge gas can not be expected at a stator B2 of the motor B and a peripheral portion of the rotor B1 which generate a great amount of heat. The above-mentioned disadvantage will eventually cause a temperature increase of the motor B, resulting in a problem regarding the reduction in the reliability and efficiency of the motor B and a problem regarding the oil mixed in the discharge gas being directly discharged outside the casing to cause oil shortage.

It is an object of the present invention to provide a scroll compressor capable of fully exerting the effect of cooling the motor by the discharge gas so as to prevent the possible temperature increase of the motor and allow the motor to have increased reliability and efficiency, and satisfactorily separating the oil mixed in the discharge gas.

SUMMARY AND OBJECTS OF THE INVENTION

According to the present invention, there is provided a combination of various elements wherein one embodiment provides for a scroll compressor including a hermetic casing; a scroll type compressing section which is disposed in one side portion of the hermetic casing and discharges compressed gas from a discharge outlet; a motor which is disposed in the other side portion and drives the compressing section by a drive shaft, wherein a middle chamber is formed between the compressing section and the motor in the hermetic casing and there is formed in the hermetic casing a chamber opposite to the compressing section which faces a surface of the motor opposite from a surface of the motor that faces the compressing section; a discharge passage which is provided axially through the drive shaft and communicates with the discharge outlet of the compressing section to discharge the compressed gas to the chamber opposite to the compressing section; passage means for making the chamber opposite to the compressing section communicate with the middle chamber; said passage means being a core cut formed by cutting a peripheral portion of a stator of the motor and an outward discharge pipe opened at the middle chamber.

According to the above-mentioned invention, the compressed gas which is compressed in the compressing section and is discharged from the discharge outlet is discharged to the chamber opposite to the compressing section via the discharge passage provided axially through the drive shaft. Subsequently, the compressed gas is guided from the chamber opposite to the compressing section via the passage means to the middle chamber provided between the compressing section and the motor, and then discharged outwardly from the discharge pipe opened at the middle chamber. With the above-mentioned arrangement, while the gas passes through the discharge passage to the chamber opposite to the compressing section, not only the rotor of the motor can be cooled by the discharge gas flowing through the discharge passage but also other portions of the motor can be cooled by the gas guided from the chamber opposite to the compressing section via the passage means around the motor to the middle chamber. As a result, the effect of cooling the motor by the gas can be fully exerted, thereby preventing the possible temperature increase of the motor to allow the reliability and efficiency to be enhanced. Furthermore, separation of oil can be performed effectively while the gas passes through the passage means extending from the chamber to the middle chamber opposite to the compressing section, and therefore the oil can be prevented from being discharged together with the compressed gas.

In an embodiment, the hermetic casing is a horizontal type in which a middle chamber oil reservoir is formed at a bottom of the middle chamber, and there is provided an oil supply passage which is opened to the middle chamber oil reservoir and communicates with a sliding portion.

With the above-mentioned arrangement, a sufficient amount of oil can be secured in the middle chamber oil reservoir by virtue of a pressure difference between the chamber opposite to the compressing section and the middle chamber. That is, the gas discharged from the discharge passage is once discharged to the chamber opposite to the compressing section, and then reaches the middle chamber while receiving a resistance as it passes through the passage means. Therefore, the pressure in the middle chamber becomes lower than the pressure in the chamber opposite to the compressing section. Therefore, even when the casing is a horizontal type, the oil collected at the bottom portion of the chamber opposite to the compressing section is made to flow into the middle chamber by virtue of the pressure difference, so that a sufficient amount of oil can be secured in the middle chamber oil reservoir. Furthermore, the oil supply passage is opened at the middle chamber oil reservoir where a sufficient amount of oil is secured, and therefore the oil collected in the middle chamber oil reservoir can be supplied accurately and sufficiently to the sliding portion via the oil supply passage.

DETAILED DESCRIPTION OF THE PREFERRED EMBODIMENTS

Figure 1:
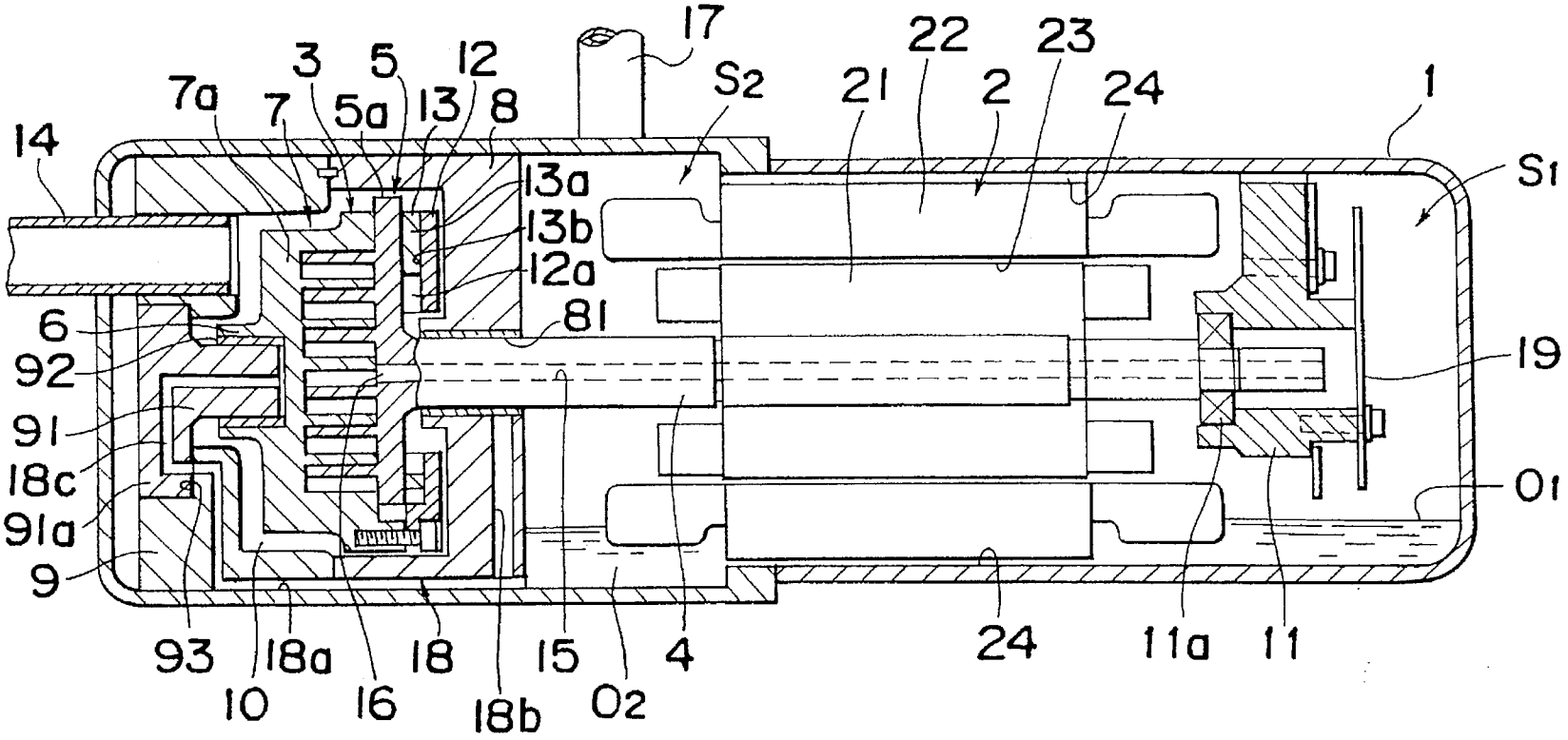
FIG. 1 is a longitudinal sectional view showing the total construction of a scroll compressor according to the present invention.
Figure 2:
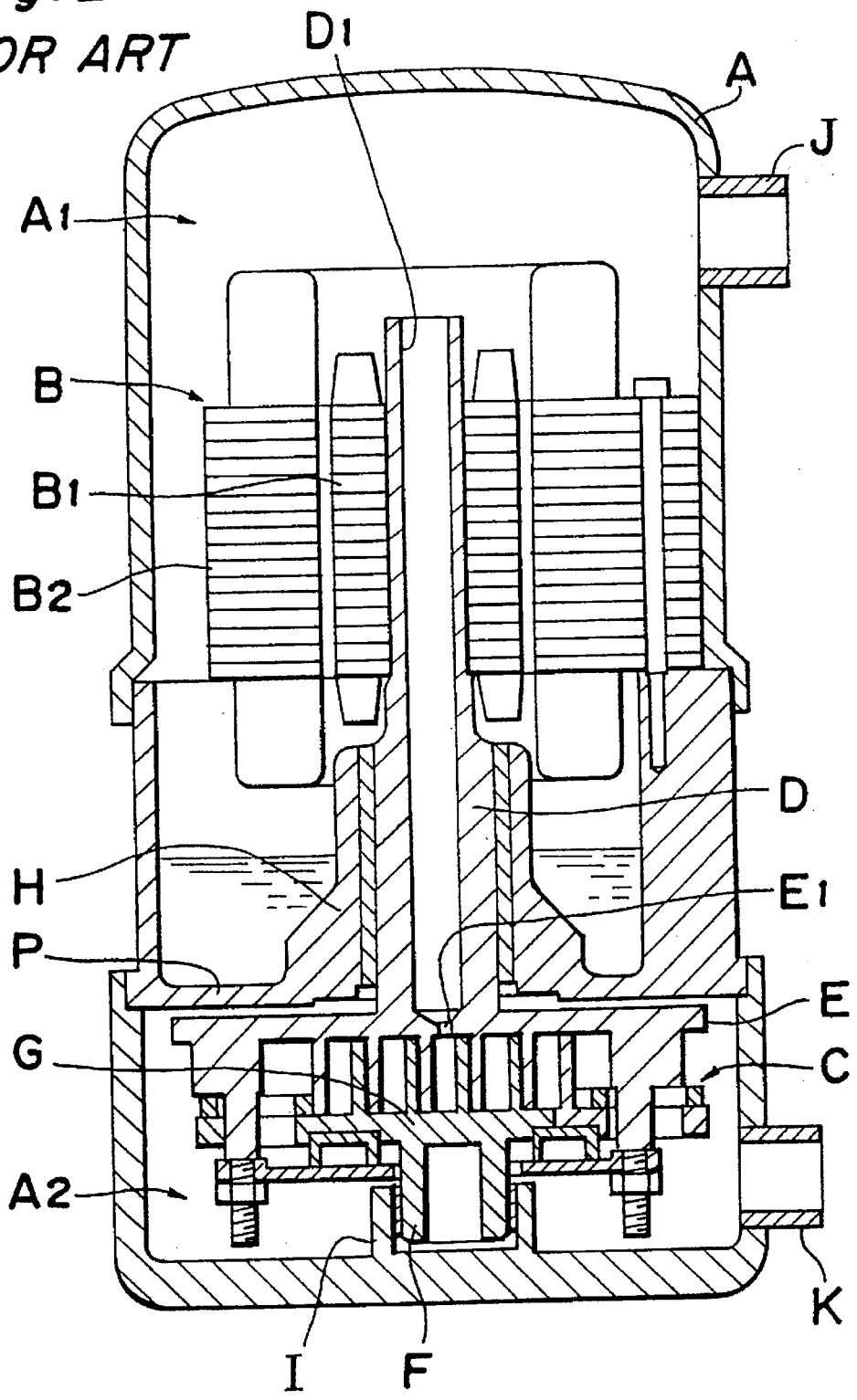
Fig. 2 PRIOR ART
FIG. 2 is a longitudinal sectional view of a prior art scroll compressor.

FIG. 1 shows a horizontal type scroll compressor provided with a co-rotational type scroll compressing section. In the compressor, a motor 2 comprised of a rotor 21 and a stator 22 is arranged internally on one side of a horizontally elongated hermetic casing 1, while a co-rotational type scroll compressing section 3 is arranged internally on the other side of the casing 1. The compressing section 3 is comprised of a drive scroll 5 integrally formed at an end of a drive shaft 4 connected to the rotor 21 of the motor 2, and a driven scroll 7 which has a driven shaft 6 and is rotated in accordance with driving of the drive scroll 5.

More in detail, a first housing 8 for rotatably supporting the drive scroll 5 and a second housing 9 for rotatably supporting the driven scroll 7 are oppositely arranged so that they separate the inside of the hermetic casing 1 and a low-pressure space 10 is formed between the first and second housings 8 and 9. That is, the housings 8 and 9 are integrally connected together by a fastening bolt (not shown) or the like, and are installed inside the casing 1. Further, the compressing section 3 is installed in the low-pressure space 10 formed inside the housings 8 and 9, and the drive and driven scrolls 5 and 7 of the compressing section 3 are arranged opposite to each other. The drive shaft 4 to be connected to the rotor 21 protrudes in an integrated form from a rear side of an end plate 5*a* of the drive scroll 5. The drive shaft 4 is rotatably supported by a first bearing 81 provided in the first housing 8, while the foremost end projected outwardly from the rotor 21 is rotatably supported by a second bearing 11*a* at the support member 11 provided in a chamber S1 opposite to the compressing section which faces the surface of the motor 2 opposite from the surface that faces the compressing section 3 in the hermetic casing 1, whereby the drive shaft 4 is supported at both the ends. The pipe-shaped driven shaft 6 protrudes from a rear side of an end plate 7*a* of the driven scroll 7, while a fixed shaft 91 of the second housing 9 is protrudingly provided as arranged eccentrically with respect to the axial center of the drive shaft 4 to rotatably support the driven shaft 6 at the fixed shaft 91 via a bearing 92. In the embodiment shown in FIG. 1, the fixed shaft 91 is comprised of a separate member to be fixed integrally to the second housing 9. The fixed shaft 91 has a mounting flange portion 91*a* having a larger diameter, and it is connected integrally to the second housing 9 with the mounting flange portion 91*a* inserted in a receiving portion 93 formed in a center portion of the second housing 9. In the above-mentioned embodiment, the driven shaft 6 provided at the driven scroll 7 has a pipe-like configuration, and the cylindrical solid fixed shaft 91 around which the driven shaft 6 is mounted is provided on the side of the second housing 9. However, according to the present invention, the fixed shaft 91 may have a pipe-like configuration, and the driven shaft 6 may have a cylindrical solid configuration to be inserted in the fixed shaft 91.

Further, a thrust plate 12 is connected to the driven scroll 7 by means of a bolt (not shown) so that the end plate 5*a* of the drive scroll 5 is interposed between them. In a containing space 12*a* between the thrust plate 12 and the end plate 5*a*, a transmission mechanism for making the driven scroll 7 rotate in accordance with the driving of the drive scroll B is interposed. The transmission mechanism is provided by a ring-shaped member, and is comprised of an Oldham's coupling 13 provided with a drive scroll side key (not shown) and a thrust plate side key 13*a* which extend radially, and a drive scroll side key groove (not shown) and a thrust plate side key groove 13*b* which extend radially and along which the keys of the Oldham's coupling 13 provided at the end plate 5*a* of the drive scroll 5 and the thrust plate 12 slide as they are engaged therewith.

When the drive scroll B is driven to rotate via the drive shaft 4 in accordance with the rotation of the motor 2, the driven scroll 7 is made to rotate around the driven shaft 6 as driven in accordance with the drive scroll 5 via the Oldham's coupling 13 and the thrust plate 12 while making the keys of the Oldham's coupling 13 slide along the respective grooves of the end plate 5*a* of the drive scroll 5 and the thrust plate 12. With the rotating motion, a gas introduced into the low-pressure space 10 from an intake pipe 14 that penetrates the casing 1 and is connected to the second housing 9 is inhaled into the compressing chamber between the scrolls 5 and 7 to perform a compressing operation.

In the above-mentioned construction, a discharge passage 15 is provided axially through the drive shaft 4 connected to the motor 2 to discharge the high-pressure gas compressed in the compressing chamber formed by the drive and driven scrolls 5 and 7 toward the chamber S1. In practice, the discharge passage 15 penetrates axially the drive shaft 4 penetrating and connected to the rotor 21 while having its one end communicating with a discharge outlet 16 opened at a center portion of the end plate 5*a* of the drive scroll 5, and having its other end opening to the chamber S1 opposite to the compressing section.

Further, an outward discharge pipe 17 is opened at a middle chamber S2 formed between the compressing section 3 and the motor 2 inside the casing 1, thereby forming a discharge gas discharge passage so that the discharge gas discharged from the discharge passage 15 to the chamber S1 opposite to the compressing section is guided to the middle chamber S2 by way of an air gap 23 formed between the rotor 21 and the stator 22 of the motor 2 as well as to the middle chamber S2 by way of a plurality of core cut sections 24 provided at peripheral portions of the stator 22, and the gas is discharged outwardly from the middle chamber S2 via the outward discharge pipe 17.

Further, an oil reservoir O1 for collecting oil that is discharged as mixed in the discharge gas from the end portion of the discharge passage 15 opened to the chamber S1 opposite to the compressing section is provided at the bottom of the chamber S1 opposite to the compressing section in the horizontally elongated casing 1, and a middle chamber oil reservoir O2 is provided at the bottom of the middle chamber S2. The oil reservoirs O1 and O2 are made to communicate with each other via the core cut sections 24 at the bottom portions, while an oil supply passage 18 which has its one end communicating with the middle chamber oil reservoir O2 and has the other ends opening to the sliding portion of respective members is formed in the first and second housings 8 and 9.

In the embodiment shown in FIG. 1, the oil supply passage 18 is formed at lower portions of the first and second housings 8 and 9, and is comprised of: a first oil supply passage 18*a* which communicates with the middle chamber oil reservoir O2 and extends straight in the axial direction; a second oil supply passage 18*b* which is formed in the first housing 8 while having its one end communicating with the first oil supply passage 18*a*, and having its other end opening to the first bearing 81 of the first housing 8; and a third oil supply passage 18*c* which is formed in the second housing 9 while having its one end communicating with the first oil supply passage 18*a*, and having its other end communicating with the bearing 92 interposed between the driven shaft 6 and the fixed shaft 91.

When the compressing section 3 is driven, the gas discharged from the discharge passage 15 is discharged to the chamber S1 opposite to the compressing section, and thereafter passes through the air gap 23 and the core cut sections 24 of the motor 2 to reach the middle chamber S2. Consequently, the discharge gas receives a resistance when it passes through the motor 2, and therefore the middle chamber S2 comes to have a pressure lower than that of the chamber S1 opposite to the compressing section. Therefore, by virtue of the pressure difference between the chamber S1 opposite to the compressing section and the middle chamber S2, the oil collected in the oil reservoir O1 of the chamber S1 opposite to the compressing section is speedily fed back to the middle chamber oil reservoir O2 having a lower pressure via the core cut sections 24. Consequently, the oil surface in the middle chamber oil reservoir O2 comes to have a level higher than that of the oil reservoir O1, thereby allowing a sufficient amount of oil to be secured. Furthermore, the low-pressure space 10 formed by the first and second housings 8 and 9 is maintained at a pressure lower than that of the middle chamber oil reservoir O2, and therefore the oil in the middle chamber oil reservoir O2 is surely supplied from the oil supply passage 18 opened at the middle chamber oil reservoir O2 to the bearings 81 and 92 via the first through third oil supply passages 18*a* through 18*c* by virtue of the pressure difference. It is to be noted that the manner of supplying oil from the middle chamber oil reservoir O2 to the bearings 81 and 92 is not limited to the above-mentioned oil supply manner by pressure difference, and it is acceptable to compulsorily supply oil by means of a pump or the like.

Furthermore, in the embodiment shown in FIG. 1, an oil separating plate 19 is fixed to the support member 11 provided in the chamber S1 opposite to the compressing section such that it opposes to the discharge passage 15 formed through the drive shaft 4. The discharge gas mixed with oil discharged from the discharge passage 15 is made to collide against the oil separating plate 19, so that the oil is positively separated, thereby allowing the oil to be collected in the oil reservoir O1.

Next, operation of the above-mentioned construction will be described. First, by driving the drive scroll 5 via the drive shaft 4 in accordance with rotation of the motor 2, the driven scroll 7 is made to rotate around the driven shaft 6 via the Oldham's coupling 13. With the rotating motion, the gas introduced from the intake pipe 14 into the low-pressure space 10 is inhaled into the compressing chamber formed between the scrolls 5 and 7, and then compressed. Then, the compressed high-pressure gas is discharged from the discharge outlet 16 provided at the drive scroll 5 via the discharge passage 15 inside the drive shaft 4 to the chamber S1 opposite to the compressing section. Then, the drive shaft 4 and the center portion of the rotor 21 of the motor 2 are cooled by the gas passing through the discharge passage 15. Further, the discharge gas discharged to the chamber S1 opposite to the compressing section is guided from the chamber S1 via the air gap 23 and the core cut sections 24 of the stator 22 of the motor 2 to the middle chamber S2 between the compressing section 3 and the motor 2, and then discharged outwardly from the outward discharge pipe 17 opened at the middle chamber S2. Therefore, the stator 22 and the peripheral portion of the rotor 21, i.e., the peripheral portion of the motor 2 is cooled by the discharge gas passing through the air gap 23 and the core cut sections 24. Therefore, the entire motor 2 can be cooled by the gas passing through the discharge passage 15 and the gas passing through the air gap 23 and the core cut sections 24. Therefore, the effect of cooling the motor 2 by the gas can be fully exerted, thereby preventing the possible temperature increase of the motor 2 and allowing the reliability and efficiency of the motor to be improved.

Furthermore, when the discharge gas passes through the air gap 23 and the core cut sections 24, oil which has not been able to be separated by the collision of oil against the oil separating plate 19 can be separated by the resistance generated there, so that the oil can be more effectively prevented from being discharged together with the compressed gas.

Further, when the compressing section 3 is driven, the oil mixed in the high-pressure gas discharged from the discharge passage 15 to the chamber S1 opposite to the compressing section is collected in the oil reservoir O1 at the bottom portion. Then, the oil reservoir O1 has a high pressure, and the middle chamber S2 has a pressure lower than that of the oil reservoir O1. Therefore, the oil in the oil reservoir O1 is speedily supplied to the middle chamber oil reservoir O2 via the core cut sections 24, thereby allowing a sufficient amount of oil to be secured in the middle chamber oil reservoir O2. Furthermore, the low-pressure space 10 formed by the housings 8 and 9 is maintained at a pressure lower than that of the middle chamber oil reservoir O2, and therefore the oil in the middle chamber oil reservoir O2 where a sufficient amount of oil is secured is surely and sufficiently supplied to the bearings 81 and 92 via the oil supply passage 18 by virtue of the pressure difference.

Although the horizontal type compressor is shown in the above-mentioned embodiment, the present invention can be of course applied to a vertical type. Furthermore, the compressing section 3 is not limited to the co-rotational type, and it is also acceptable to adopt a scroll compressing section provided with a fixed scroll and a movable scroll.

According to the embodiment as described above, there is provided the scroll compressor in which the compressing section 3 and the motor 2 are mounted respectively on one side and on the other side in the hermetic casing 1, and a high-pressure gas compressed in the compressing section 3 is discharged into the casing 1 and then discharged to the outside of the casing via the outward discharge pipe 17. In the scroll compressor, the discharge passage 15 which communicates with the discharge outlet 16 of the compressing section 3 and discharges the high-pressure gas to the chamber S1 opposite to the compressing section of the motor 2 is provided axially through the drive shaft 4 connected to the motor 2, and the outward discharge pipe 17 is opened at the middle chamber S2 between the compressing section 3 and the motor 2 of the casing 1.

With the above-mentioned arrangement, the high-pressure gas that is compressed in the compressing section 3 and discharged from the discharge outlet 16 is discharged to the chamber S1 opposite to the compressing section via the discharge passage 15 provided on the central side of the rotor 21, and thereafter guided from the chamber S1 opposite to the compressing section via the air gap 23 and the core cut sections 24 to the middle chamber S2 provided between the compressing section 3 and the motor 2 to be then discharged outwardly from the outward discharge pipe 17 opened at the middle chamber S2. Therefore, while the high-pressure gas passes through the discharge passage 15 to reach the chamber S1 opposite to the compressing section, not only the rotor 21 of the motor 2 can be cooled by the discharge gas flowing through the discharge passage 15 but also the stator and the peripheral portion of the rotor of the motor 2 can be cooled by the gas that is guided from the chamber S1 via the motor 2 to the middle chamber S2 at which the outward discharge pipe 17 is opened. As a result, the effect of cooling the motor 2 by the gas can be fully exerted, so that the possible temperature increase of the motor 2 can be prevented, thereby allowing the reliability and efficiency to be enhanced. Furthermore, the separation of oil can be satisfactorily achieved while the gas passes from the chamber S1 opposite to the compressing section through the motor 2, and therefore the possible depletion of oil can be surely prevented.

Furthermore, according to the above-mentioned embodiment, the hermetic casing 1 is of a substantially horizontal type, in which the middle chamber oil reservoir O2 is provided at the bottom portion of the middle chamber S2, and there is provided the oil supply passage 18 which is opened at the middle chamber oil reservoir O2 and communicates with the sliding portion of respective members. With the above-mentioned arrangement, a sufficient amount of oil can be secured in the middle chamber oil reservoir O2 by virtue of the pressure difference between the chamber S1 opposite to the compressing section and the middle chamber S2. Furthermore, the oil supply passage 18 is opened at the middle chamber oil reservoir O2 where a sufficient amount of oil is secured, and therefore the oil that is reserved in the middle chamber oil reservoir O2 can be accurately and sufficiently supplied to the sliding portion of respective members via the oil supply passage 18.

The present scroll compressor is provided for use in air conditioners, refrigerators and so forth.

What is claimed is:

1. A scroll compressor comprising:

a substantially horizontal type hermetic casing;

a scroll type compressing section is disposed in one side portion of the hermetic casing and discharges compressed gas from a discharge outlet;

a motor is disposed in the other side portion for driving the compressing section by a drive shaft, wherein a middle chamber is formed between the compressing section and the motor in the substantially horizontal type hermetic casing, a chamber formed in the substantially horizontal type hermetic casing opposite to the compressing section which faces a surface of the motor opposite from a surface of the motor that faces the compressing section;

a middle chamber oil reservoir formed at a bottom portion of the middle chamber;

an oil supply passage in communication with the middle chamber oil reservoir and in communication with a sliding portion;

a discharge passage provided axially through the drive shaft and communicating with the discharge outlet of the compressing section to discharge the compressed gas to the chamber opposite to the compressing section;

passage means for making the chamber opposite to the compressing section communicate with the middle chamber; and an outward discharge pipe opened at the middle chamber.

2. The scroll compressor according to claim 1, wherein the compressing section includes a drive scroll for rotating as the drive scroll is interlocked with the drive shaft and a driven scroll rotatable mounted to rotate in accordance with the rotation of the drive scroll around a driven shaft arranged eccentrically with respect to an axial center of the drive shaft.

3. The scroll compressor according to claim 1, wherein the passage means is an air gap formed between a rotor and a stator of the motor.

4. A scroll compressor comprising:

a hermetic casing;

a scroll type compressing section is disposed in one side portion of the hermetic casing and discharges compressed gas from a discharge outlet;

a motor is disposed in the other side portion for driving the compressing section by a drive shaft, wherein a middle chamber is formed between the compressing section and the motor in the hermetic casing and there is formed in the hermetic casing a chamber opposite to the compressing section which faces a surface of the motor opposite from a surface of the motor that faces the compressing section;

a discharge passage provided axially through the drive shaft and communicating with the discharge outlet of the compressing section to discharge the compressed gas to the chamber opposite to the compressing section;

passage means for making the chamber opposite to the compressing section communicate with the middle chamber;

an outward discharge pipe opened at the middle chamber;

a support member for supporting an end portion of the drive shaft opposite from the compressing section, and an oil separating plate facing an opening of the discharge passage mounted on the support member for engaging compressed gas discharged from the discharge passage.

5. The scroll compressor according to claim 4, wherein the compressing section includes a drive scroll for rotating as the drive scroll is interlocked with the drive shaft and a driven scroll rotatable mounted to rotate in accordance with the rotation of the drive scroll around a driven shaft arranged eccentrically with respect to an axial center of the drive shaft.

6. The scroll compressor according to claim 4, wherein the passage means is an air gap formed between a rotor and a stator of the motor.

7. A scroll compressor comprising:

a hermetic casing;

a scroll type compressing section is disposed in one side portion of the hermetic casing and discharges compressed gas from a discharge outlet;

a motor which is disposed in the other side portion for driving the compressing section by a drive shaft, wherein a middle chamber is formed between the compressing section and the motor in the hermetic casing and there is formed in the hermetic casing a chamber opposite to the compressing section which faces a surface of the motor opposite from a surface of the motor that faces the compressing section;

a discharge passage provided axially through the drive shaft and communicating with the discharge outlet of the compressing section to discharge the compressed gas to the chamber opposite to the compressing section;

passage means for making the chamber opposite to the compressing section communicate with the middle chamber, said passage means being a core cut formed by cutting a peripheral portion of a stator of the motor; and an outward discharge pipe opened at the middle chamber.

8. The scroll compressor according to claim 7, wherein the compressing section includes a drive scroll for rotating as the drive scroll is interlocked with the drive shaft and a driven scroll rotatable mounted to rotate in accordance with the rotation of the drive scroll around a driven shaft arranged eccentrically with respect to an axial center of the drive shaft.

* * * * *